US012434790B2

(12) United States Patent
Batcheller, Jr. et al.

(10) Patent No.: US 12,434,790 B2
(45) Date of Patent: Oct. 7, 2025

(54) SNAG-FREE INSERTS FOR INFLATABLE BOATS

(71) Applicants: Michael Richard Batcheller, Jr., Bainbridge Island, WA (US); Martin Scott Sheppard, Maupin, OR (US)

(72) Inventors: Michael Richard Batcheller, Jr., Bainbridge Island, WA (US); Martin Scott Sheppard, Maupin, OR (US)

( * ) Notice: Subject to any disclaimer, the term of this patent is extended or adjusted under 35 U.S.C. 154(b) by 640 days.

(21) Appl. No.: 17/684,200

(22) Filed: Mar. 1, 2022

(65) Prior Publication Data

US 2022/0185430 A1 Jun. 16, 2022

Related U.S. Application Data

(60) Provisional application No. 63/156,849, filed on Mar. 4, 2021.

(51) Int. Cl.
*B63B 7/08* (2020.01)

(52) U.S. Cl.
CPC ..... *B63B 7/082* (2013.01)

(58) Field of Classification Search
CPC ..... B63B 7/082; B63B 7/085
See application file for complete search history.

(56) References Cited

U.S. PATENT DOCUMENTS 4,779,555 A * 10/1988 Hong ..... B63B 7/082 441/40
2019/0351975 A1* 11/2019 Hardee ..... B63B 7/082

OTHER PUBLICATIONS

Letmrun Drift Boats, website, accessed Feb. 19, 2022, all pages relevant, <https://www.letmruntvl.com/>.

* cited by examiner

*Primary Examiner* — Andrew Polay
(74) *Attorney, Agent, or Firm* — Bamert Regan PLLC

(57) ABSTRACT

Embodiments are directed toward an insert for an inflatable boat having a hull and an inflatable peripheral tube that define a boat cockpit. The insert has a rigid floor and a rigid peripheral sidewall that define an insert cockpit. The insert is configured to register with the boat cockpit while the floor of the insert covers most of the upper surface of the hull and while the peripheral sidewall of the insert covers most of the inner surface of the peripheral tube. Accordingly, the insert facilitates increasing rigidity of the inflatable boat while reducing snaggable features in the inflatable boat.

20 Claims, 8 Drawing Sheets

SNAG-FREE INSERTS FOR INFLATABLE BOATS

CROSS REFERENCE TO RELATED APPLICATION

This non-provisional application claims the benefit of provisional application Ser. No. 63/156,849, filed Mar. 4, 2021, titled SNAG-FREE INSERTS FOR INFLATABLE BOATS, the entirety of which is hereby incorporated herein by reference.

TECHNICAL FIELD

The invention relates to inserts for inflatable boats and, more particularly, to snag-free inserts for inflatable boats.

BACKGROUND OF THE INVENTION

Drift boats for flyfishing and especially guided flyfishing generally fall into two categories: (1) hardbody boats and (2) inflatable boats. Hardbody drift boats have heavy, rigid bodies typically made of metal, wood, or fiberglass that facilitate walking in the boats and supporting accessories, but hardbody drift boats are difficult to transport and have a tendency to spook fish by making loud noises when crashing into or sliding along rocks in the water. Inflatable drift boats have lightweight, flexible bodies and therefore make it challenging to walk in the boats or to support accessories, but inflatable boats are easy to transport and are less likely to spook fish because the flexible bodies make little noise when contacting rocks in the water. Accordingly, inflatable boats are highly popular for fishing. Inflatable boats typically have inflatable chambers defined by peripheral tubes that extend across the bow of the boat, along the port and starboard peripheral edges of the boat, and toward the stern of the boat. A hull typically extends between the peripheral tubes. The hull may or may not be inflatable. For non-inflatable hulls, the hull may or may not be rigid. In each of these scenarios, the buoyancy of the boat relies on the chambers remaining inflated. The chambers may deflate if punctured, such as by a rock or a fishing lure or fly while a passenger casts.

In addition to the inflatable and non-rigid portions of inflatable boats, standard inflatable boats have many features that a fishing lure or fly may snag while casting, such as elevated benches defined by planks that extend from a top of the port peripheral tube to a top of the starboard peripheral tube. Inflatable boats that specifically are designed or modified for fishing (for example, boats available under the mark RIVER RAT USA or the mark LETMRUN) include even more surfaces that a fishing lure or fly may snag, such as elevated chairs disposed on crossbeams, thwarts, or yokes that extend between the peripheral tubes, along with other numerous metal tubes such as thwarts, yokes, and floor-level crossbeams (e.g., crossbeams that sit on or extend a couple inches above the floor) extending across and throughout the boat to provide rigidity and to define various structures such as oar-lock platforms. Inflatable boats specifically designed or modified for fishing also have many projections such as bolts that snag not only fishing lines, lures, or flies but also clothing of passengers moving about the boat while fishing. Such projections also present tripping hazards, and clothing, feet, or limbs may become tangled or otherwise caught by such projections. In some cases, such snagging or tangling can lead to drowning such as when the boat gets stuck in an eddy current as found near waterfalls.

The hulls of inflatable boats for white-water rafting are inflatable and define inflatable floors that are self-bailing. The floors provide a flexible surface, like an air mattress, that acts as a fifth chamber in the boat (the other four chambers defining the four quadrants of the perimeter) with holes around the perimeter of the floor to allow water to drain from inside the boat. The floors add buoyancy to the boat, enabling the boat to stay afloat when one of the peripheral chambers deflates so long as the floor remains inflated. In general, there are two types of white-water inflatable boats. The first type is for "boat boys" who are typically employed by a charter or guide company that raft ahead with customer's gear. This boat is typically larger with significant amounts of aluminum framing in the passenger space that frequently snags ankles and clothing. The second type is for customers of guided fishing tours. This boat also has significant aluminum, tubular framing in the passenger space that frequently snags ankles and clothing. In either case, the inflatable floor is difficult to walk, much like a floating air mattress.

Accordingly, there is a need to prevent snagging lures or flies in inflatable boats. There is also a need to make inflatable boats safer for passengers to move about while fishing. There is a further need to keep passengers afloat if the chambers deflate. There is also a need to achieve these objectives while providing a stiffened inflatable boat that makes it easier to walk throughout the boat and to increase the energy transferred from the rower to the water.

BRIEF SUMMARY OF THE INVENTION

It is therefore an object of the present invention to provide an inflatable boat that provides a snag-free environment in the inflatable boat.

It is also an object of the present invention to provide inflatable boats that achieve the above object and that also improve safety for passengers to move about the interior of the inflatable boat.

It is another object of the present invention to provide inflatable boats that achieve the above objects and that also keep passengers afloat if inflation chambers of the inflatable boat deflate.

It is a further object of the present invention to provide inflatable boats that achieve the above objects and that also provide stiffened interior and upper surfaces without impeding the passengers or presenting surfaces that can be or are likely to be snagged by human limbs, clothing, fishing lures, or fishing flies.

The invention achieves the above objects, as well as other objects and advantages that will become apparent from the description that follows, by providing an insert for an inflatable boat. The inflatable boat has a hull and a peripheral, inflatable tube that extends around the hull periphery, and the hull and the inflatable tube define a boat cockpit. The insert includes a rigid floor and a rigid peripheral sidewall that define an insert cockpit. The insert is configured to removably register with the boat cockpit while the floor of the insert covers most of the upper surface of the hull and while the peripheral sidewall of the insert covers most of the inner surface of the peripheral tube. Accordingly, the insert facilitates increasing rigidity of the inflatable boat while reducing snaggable features of the inflatable boat.

In some embodiments, the insert is devoid of projections such as crossbeams, thwarts, and tubes. In some embodiments, the insert is devoid of sharp features such as non-radiused corners and fasteners.

In some embodiments, the peripheral sidewall extends over an upper surface of the peripheral tube when the insert is in registration with the boat cockpit. In some embodiments, the peripheral wall defines oar-lock platforms that are configured to receive and retain oar locks above the peripheral tube when the insert is in registration with the boat cockpit. In some embodiments, the peripheral wall covers a port portion of the peripheral tube and covers a starboard portion of the peripheral tube when the insert is in registration with the boat cockpit. In some embodiments, the peripheral wall defines a port recess and a starboard recess that is opposite the floor from the port recess, and the port recess and the starboard recess are configured to registrably receive a seat. In some embodiments, the seat is installed in the insert without employing a fastener, and the seat is a snag-free seat.

In some embodiments, the floor has a central region, a bow region, and a stern region. In some embodiments, one or both of the bow region or the stern region defines a respective incline that extends upward from the central region. In some embodiments, the floor has a drain hole in one or both of a bow or stern region of the insert cockpit. In some embodiments, the drain hole is disposed over a valve in a floor chamber of the hull when the insert is in registration with the boat cockpit. In some embodiments, a cap removably plugs the drain hole in a water-tight manner to provide selective access to the valve and thereby inflate or deflate the peripheral tube of the inflatable boat.

In some embodiments, the floor defines a crown that peaks along a central axis of the floor to facilitate water running away from the central axis of the floor. In some embodiments, a gutter that extends around the floor, and the gutter has portions that are lower than the floor. In some embodiments, the gutter is solid to facilitate the insert floating. In other embodiments, the gutter has perforations to facilitate water in the gutter draining out of the insert so that the insert is self bailing.

In some embodiments, the peripheral sidewall has boat couplers that facilitate securing the insert in the boat cockpit.

In some embodiments, the insert is nestingly stored in another similar insert, such that installation of the insert in the boat includes removing the insert from the other insert, thereby improving storage of the inserts.

In some embodiments, the insert is manufactured with composite infusion, such as carbon fiber open molding or infusion, fiberglass open molding or infusion, or others, by laying up dry composite layers in an open mold that defines an inverted shape of the insert, applying a vacuum surface such as a bag to an opposite side of the layers after laying them up, pulling a vacuum in the space defined by the surface and the open mold (with the layers in such space), and injecting resin into such space. Accordingly, the manufacturing process facilitates a unitary body for the insert that provides improved structural integrity over multiple hand-laid composite components that are subsequently joined to form the body.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT OF THE INVENTION

A snag-free insert for inflatable boats in accordance with the principles of the invention is generally indicated at reference number 2 in the various figures of the attached drawings wherein numbered elements in the figures correspond to like numbered elements herein.

Figure 1:
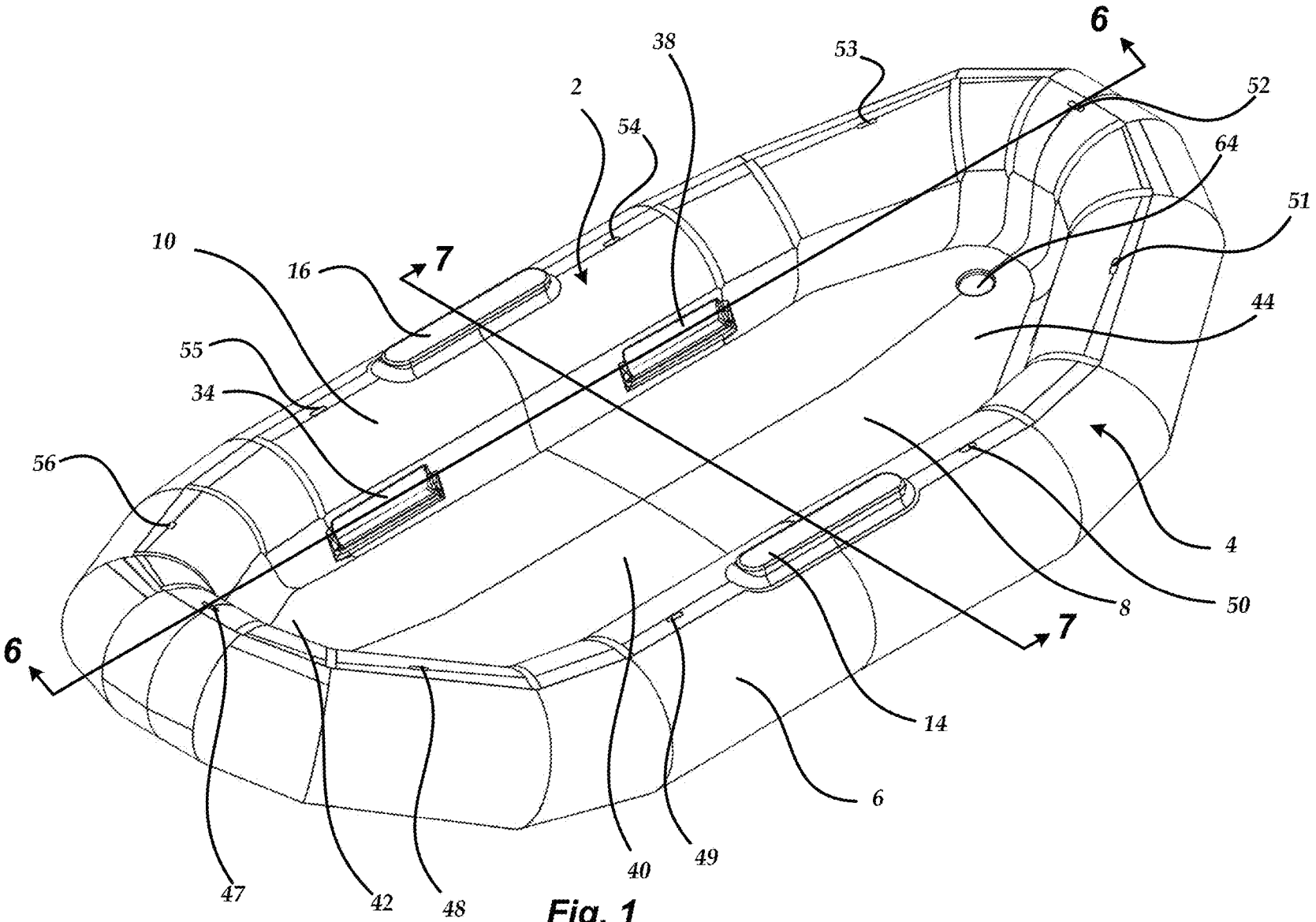
FIG. 1 is an isometric perspective view of an insert disposed in an inflatable boat according to the principles of the invention.

FIG. 1 shows the insert 2 installed in the cockpit of an inflatable boat 4. The boat 4 has one or more inflatable chambers defined by one or more peripheral tubes that are typically rubber and that define the gunnels or gunwales of the boat 4. In the embodiment shown in FIG. 1, the boat 4 has a continuous peripheral tube 6 that extends around the entire periphery of the boat 4 and that defines the gunnel of the boat 4, and the tube 6 defines one or more inflatable chambers. In other embodiments, the entire periphery of the boat 4 except for the transom is defined by one or more peripheral tubes that define one or more inflatable chambers. The insert 2 is configured to be nestingly received and registered in the boat 4. The insert 2 has a rigid floor 8 and one or more rigid peripheral sidewalls that extend upward from the periphery of the floor 8. The one or more peripheral sidewalls are configured to extend along and over a majority of each inner face of each of the one or more peripheral tubes of the boat 4. In some embodiments, where the transom lacks an inflatable tube, the one or more peripheral sidewalls of the insert 2 cover at least a portion of the inner side of the transom and thereby increase rigidity of the insert 2, and in other embodiments, the insert 2 does not cover the non-inflatable transom.

Figure 2:
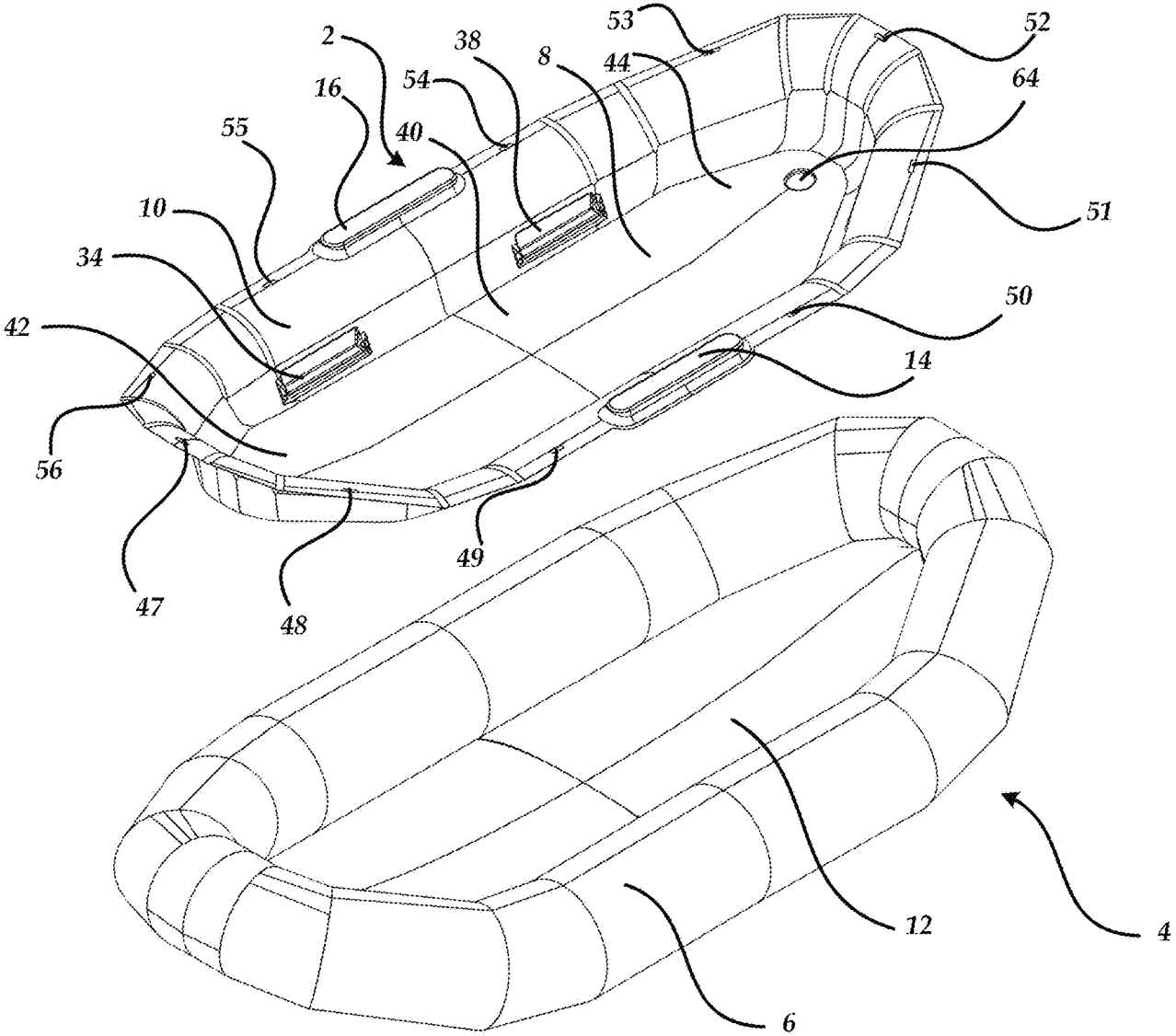
FIG. 2 is an isometric perspective view of the insert of FIG. 1 separated from the inflatable boat.

In the embodiment shown in FIG. 1, the boat 4 has one peripheral tube 6 that extends along the entire perimeter of the boat 4, so the insert 2 has one continuous peripheral sidewall 10 that extends along the entire inner side of the peripheral tube 6. In some embodiments, the insert 2 forms a unitary structure defined by the floor 8 and the peripheral sidewall 10. The upper surfaces of the floor 8 and the inner surfaces of the sidewall 10 are generally devoid of surfaces that may be snagged by fishing lures or flies and, as shown in FIGS. 1 and 2, protect the tube 6 and boat floor 12 from puncture by lures or flies in the boat 4. In particular, the insert 2 covers the entirety of the upper surface of the floor 12 of the boat 4 and, in some embodiments, covers at least a portion of the peripheral deck defined by the upper surface of the peripheral tube 6 that defines the gunwales. The insert 2 is devoid of sharp corners (for example, all surface transitions or corners are radiused), poles, tubes, thwarts, yokes, or fasteners (except oar locks, as described below). Accordingly, the insert 2 provides a snag-free environment in the boat 4.

The insert 2 is generally rigid and lightweight. In some embodiments, the exterior material of the insert 2 includes laid up fiberglass, infused carbon fiber, or thermoformed plastic using positive or negative dies. In some embodiments, the floor 8 includes a core (not shown) encased in the exterior material. In some embodiments, the floor core includes plywood or foam, such as polyethylene terephthalate (PET), recycled PET (rPET), Divinycell, or others. In some embodiments, the foam core of the floor 8 is approximately ⅜ inches thick. In some embodiments, the foam core of the floor 8 has a density of at least 70, 80, 90, 100, or 115 kilograms per cubic meter. In some embodiments, much of the remainder of the insert 2 other than the floor 8, such as the sidewall 10, includes a laminate bulker (not shown), such as bulker available under the mark LANTOR SORIC®, that is approximately 3 millimeters thick and encased by the exterior material. In other embodiments, the remainder of the insert 2 other than the floor 8 includes one of the materials described with respect to the floor core to provide a core (not shown) that is approximately ⅛ to ¼ inches thick that is encased by the exterior material. The insert 2 preferably has oar-lock platforms, such as the oar-lock platforms 14, 16, disposed on the port and starboard portions of the insert 2 at the top of the sidewall 10. In some embodiments, the oar-lock platforms 14, 16 are thicker than the rest of the insert 2 (for example, the oar-ock platforms 14, 16 are defined by thicker cores that include one or more of the materials described with respect to the floor core) to facilitate securely receiving a fastener such as a bolt to couple oar locks (for example, aluminum oar locks) (not shown) to the insert 2. Accordingly, the insert 2 is rigid and lightweight such that it may be easily carried by hand by two average-strength adult humans.

Figure 3:
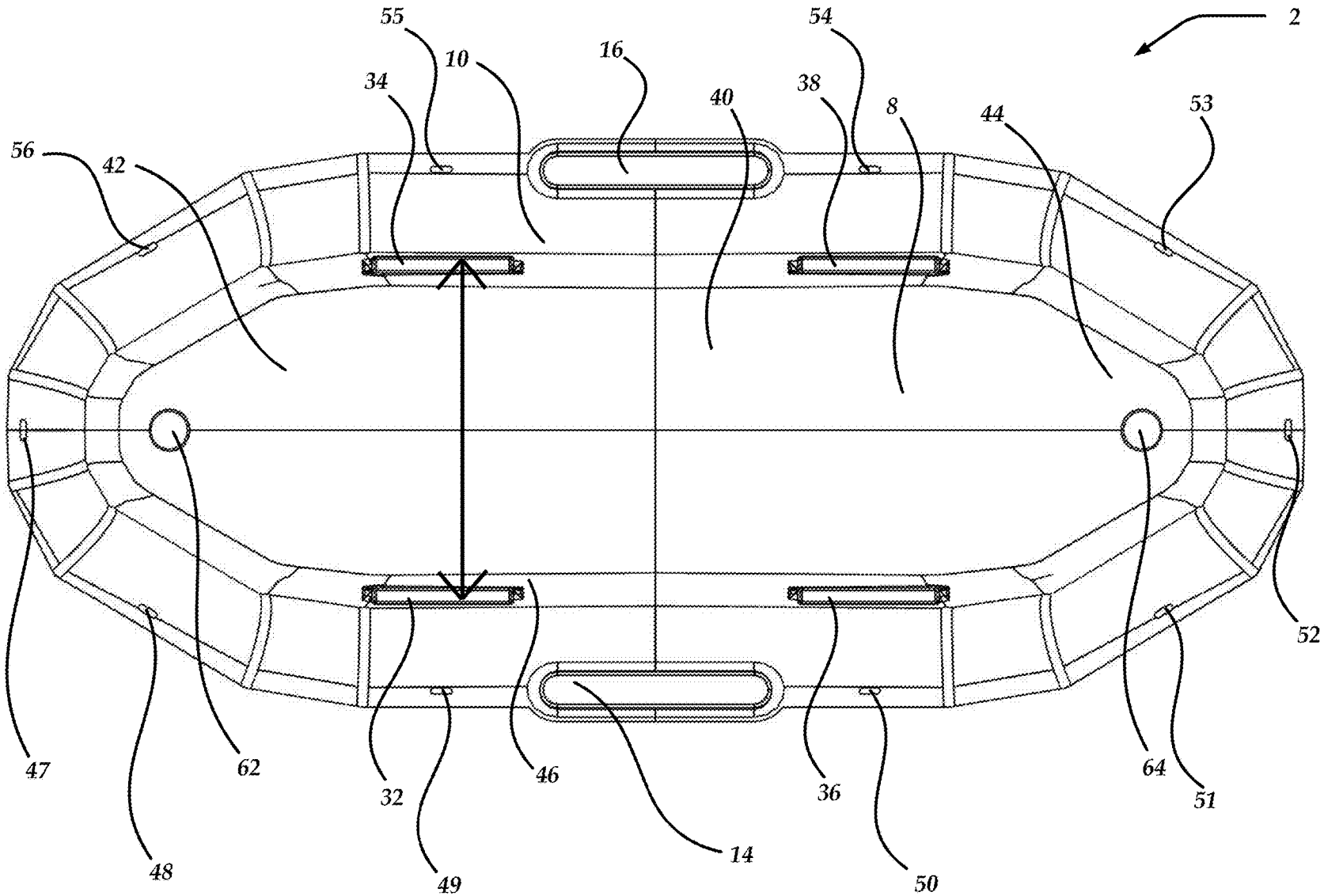
FIG. 3 is an isometric top plan view of the insert of FIG. 1.
Figure 4:
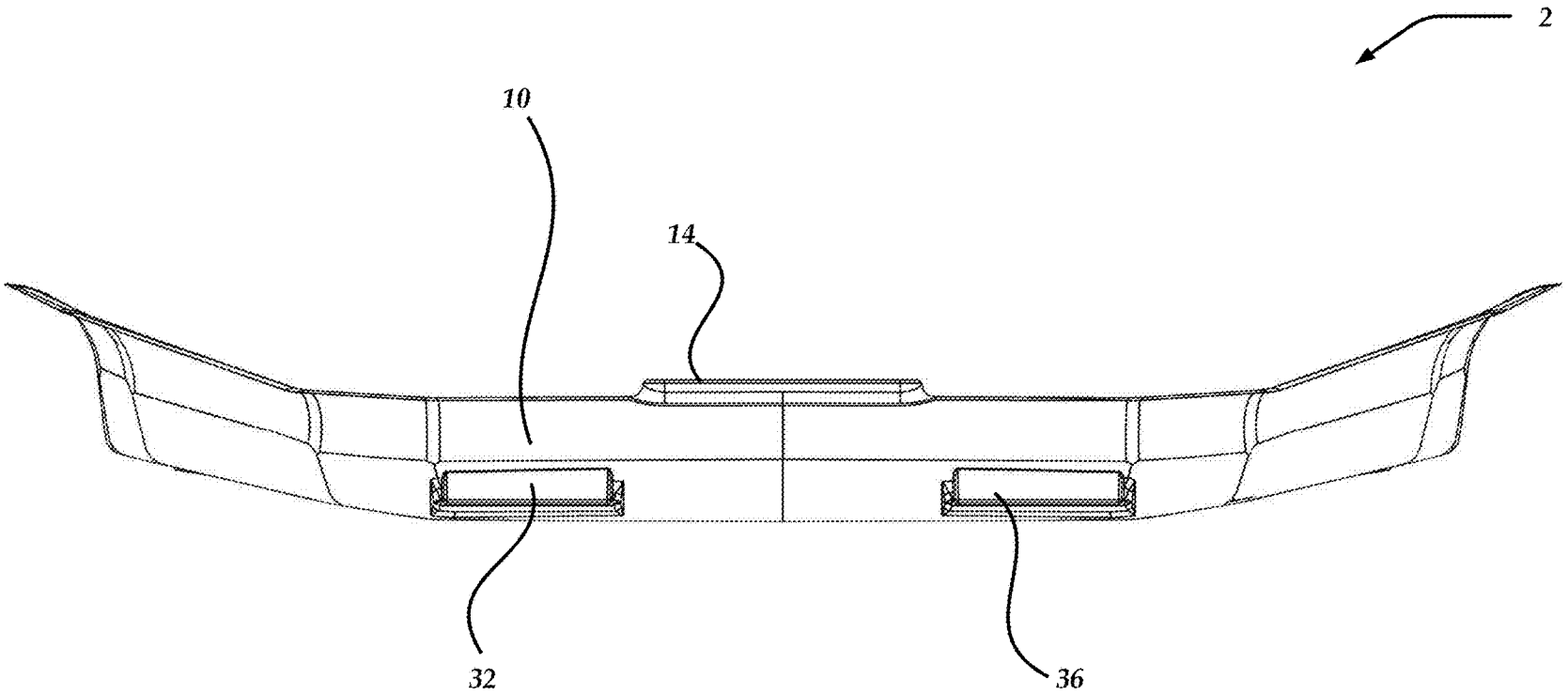
FIG. 4 is an isometric port elevational view of the insert of FIG. 1.

As shown in FIG. 3, the insert 2 has seat receptacles, such as the seat receptacles 32-38 disposed in the sidewall 10. Each of the receptacles 32, 36 disposed on the port side of the insert 2 is longitudinally aligned with a respective one of the receptacles 34, 38 that are disposed on the starboard side of the insert 2 to define a first pair of receptacles 32, 34 and a second pair of receptacles 36, 38. Each pair of seat receptacles facilitates removably receiving a seat, such as the seat 70 in FIG. 22 or the seat 72 in FIG. 23, that extends from the port side of the insert 2 to the starboard side of the insert 2 into registry with the pair of seat receptacles (i.e., as represented with the double-sided arrows in FIGS. 3, 22, and 23, the left-to-right lengths of the seats 70 and 72 as shown in the bow elevational views of FIGS. 22 and 23 is approximately the same as the distance between the inner surface of the substantially vertically portion of the port seat receptacle and the inner surface of the substantially vertical portion of the starboard seat receptacle in each receptacle pair). As shown in the figures (for example, FIG. 5), the receptacles 32-38 are recessed outward from the sidewall 10, with a substantially vertical portion and a substantially horizontal portion defining the receptacles 32-38. In some embodiments, the seat receptacles 32-38 are configured to receive the seats with an interference fit, thereby preventing the seats from sliding forward or aft and also toward starboard or port, and thus facilitate retaining the seats without use of fasteners that could snag passengers, clothing, fishing lines, flies, or lures. In some embodiments, the seats 70, 72 are defined by openable and closable containers such as coolers or livewells that can be hand lifted out of the insert 2 by one average-strength adult human.

Figure 6:
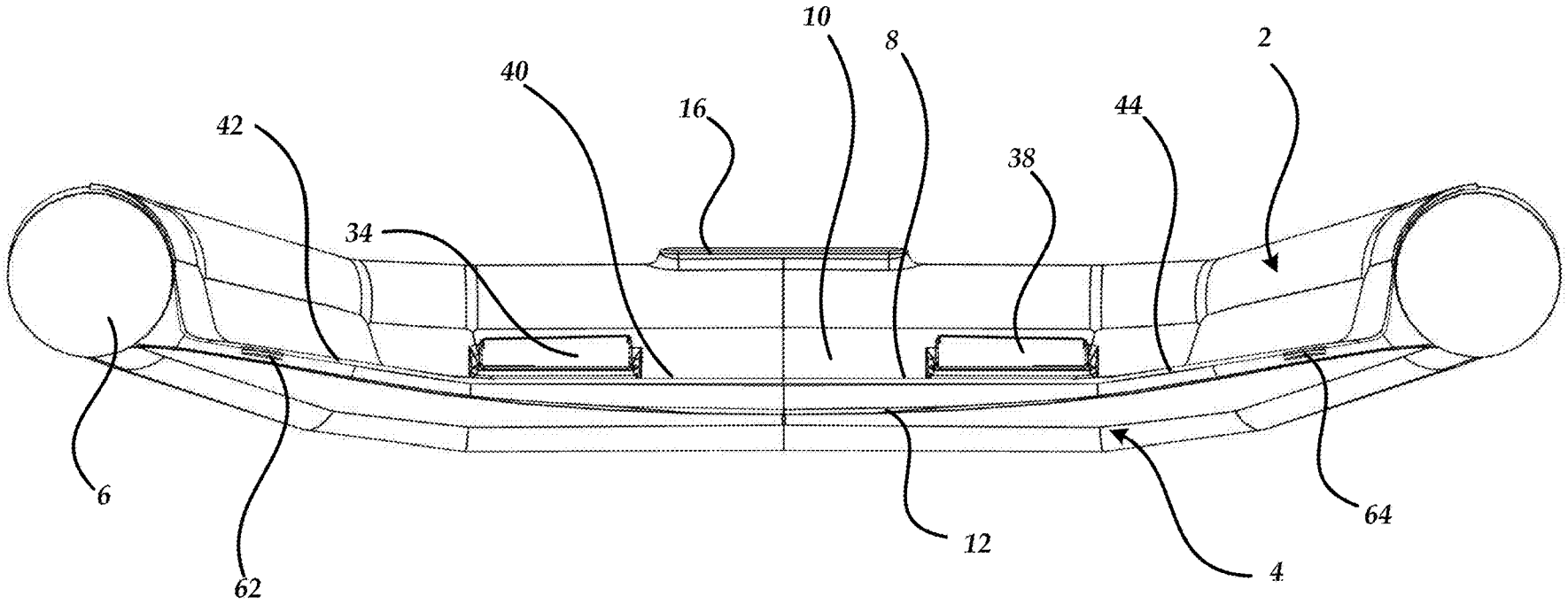
FIG. 6 is an isometric cross-sectional view of the insert and boat of FIG. 1, taken along line 6-6 in FIG. 1.

As shown in FIG. 6, the floor 8 is defined by a central region 40 and bow and stern regions 42, 44 that are inclined along their respective central axes relative to the central axis of the central region 40, wherein such central axes of the regions 40-42 are parallel to the longitudinal axis of the insert 2 when viewed from above (see FIG. 3), thereby defining a rocker or rocker angle. In some embodiments, the seat receptacles 34-38 are longitudinally aligned with the central region 40 and elevated above the central region 40 to facilitate the seats 70, 72 extending laterally across, over, and spaced above the central region 40 by a short distance (for example, a half, one, or two inches to allow water on the central region to flow under the seats 70, 72. As shown in FIGS. 22 and 23, the seats 70, 72 are devoid of snaggable features and have radiused corners and solid walls instead of and without poles, tubes, or cross members, and such solid walls preferably define storage compartments under sitting surfaces atop of such seats 70, 72. As shown in FIG. 22, the seat 70 has a lid portion 74 that defines a sitting region and forms an openable and closable cap to a container portion 76 that is configured to register with the seat receptacles 32-38. As shown in FIG. 23, the seat 72 has a lid portion 78 that defines a sitting region and forms an openable and closable cap to a container portion 80 that is configured to register with the seat receptacles 32-38. The seats 70, 72 are configured to be vertically retained in the receptacles 34-38 by their own weight or an interference fit. In some embodiments, the seats 70, 72 are replaced with snag-free casting stands that are configured in similar manners as the snag-free seats 70, 72.

Figure 5:
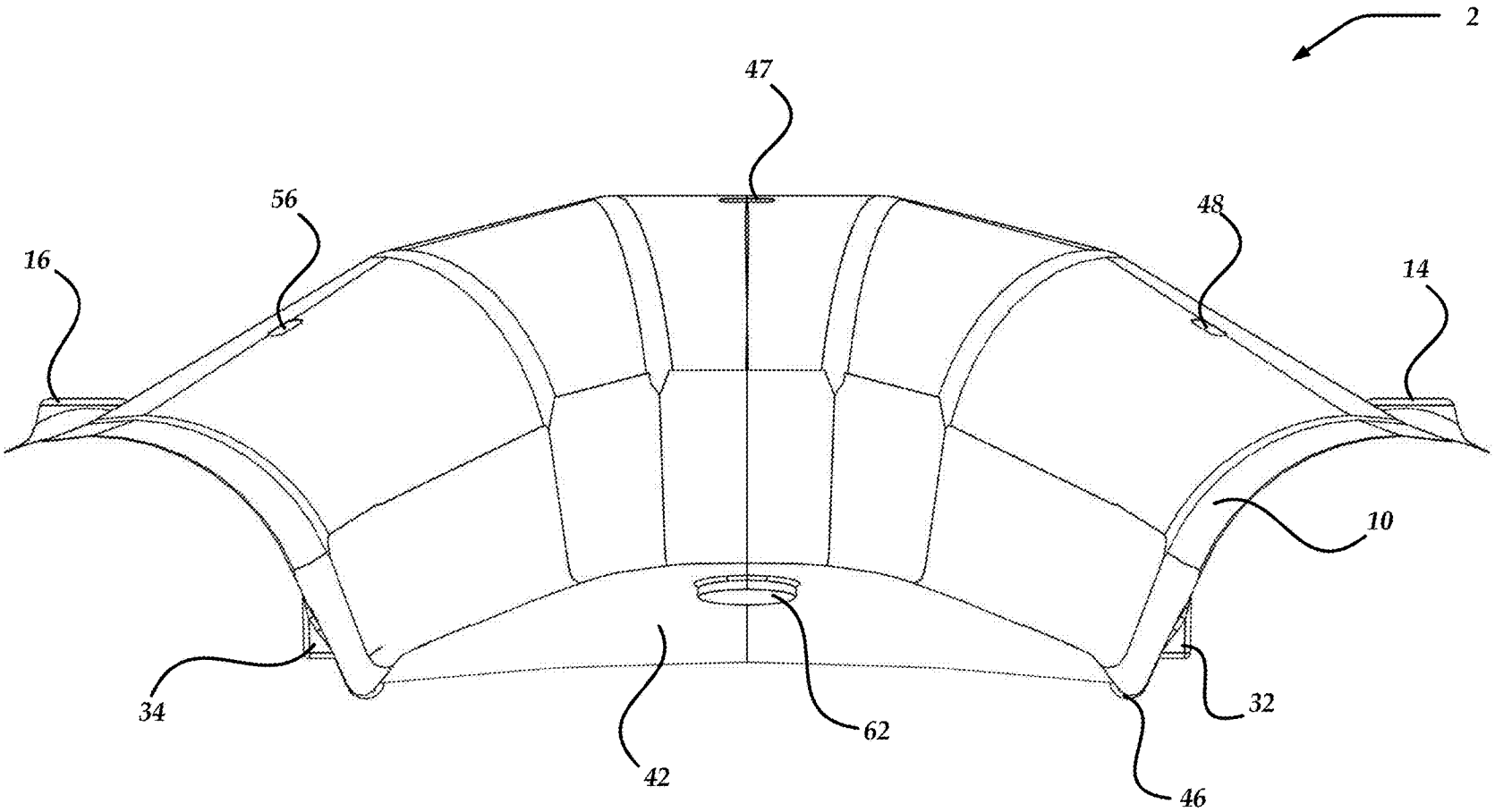
FIG. 5 is an isometric bow elevational view of the insert of FIG. 1.
Figure 7:
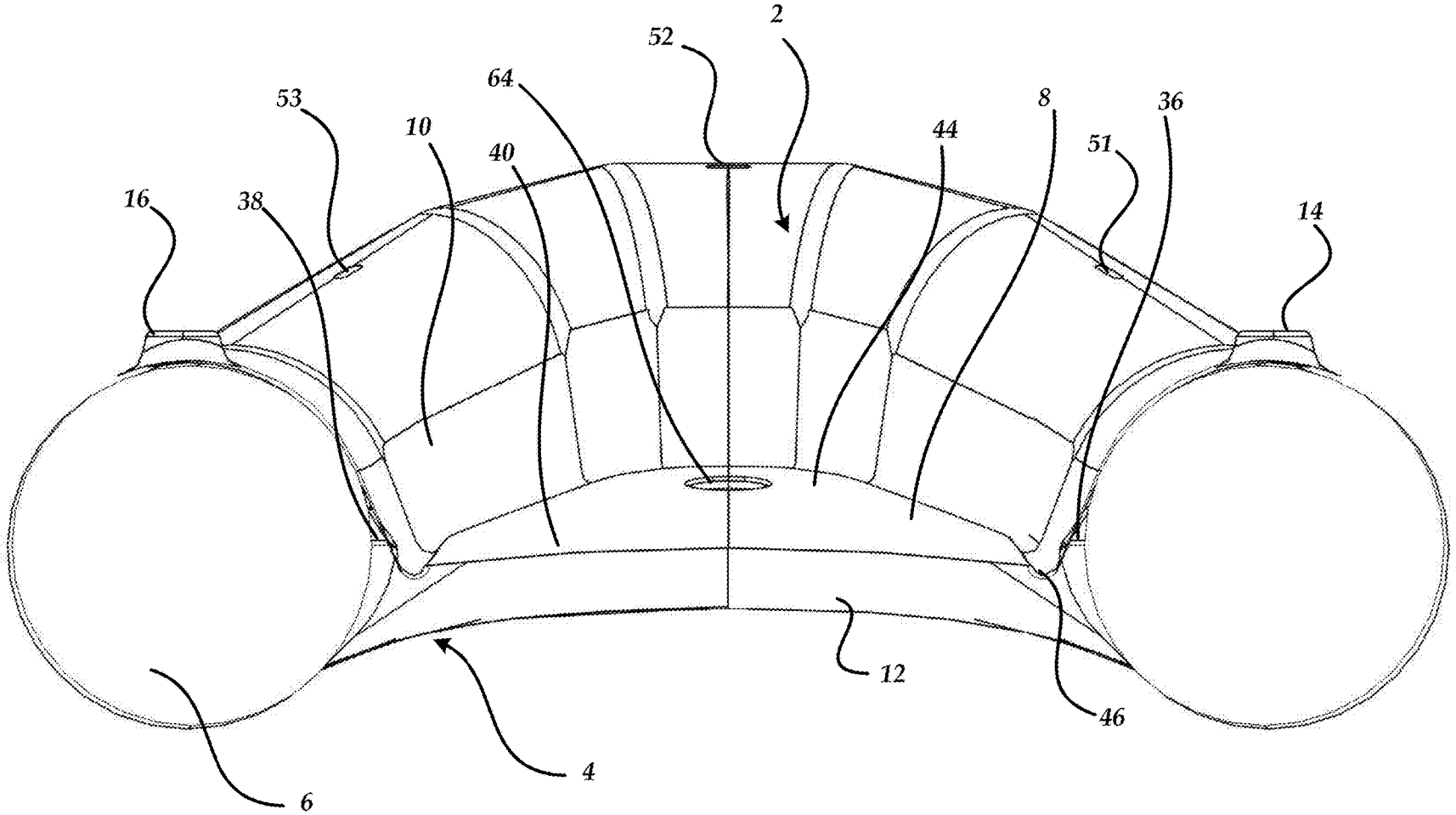
FIG. 7 is an isometric cross-sectional view of the insert and boat of FIG. 1, taken along line 7-7 in FIG. 1.
Figure 8:
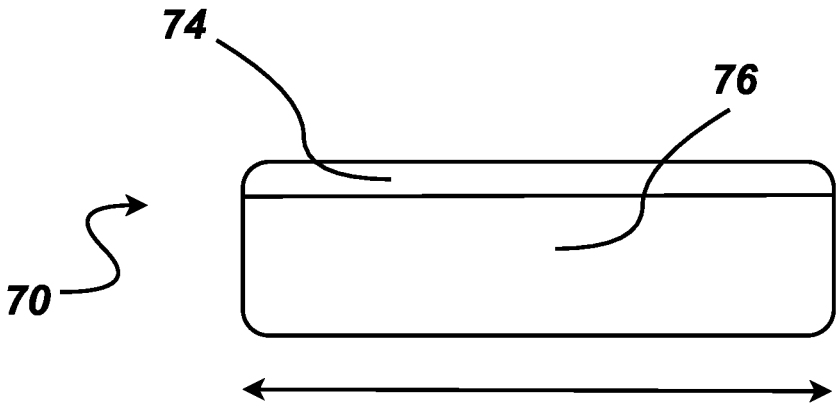
FIG. 8 is an isometric bow elevational view of a seat configured to be received in the insert of FIG. 1.
Figure 9:
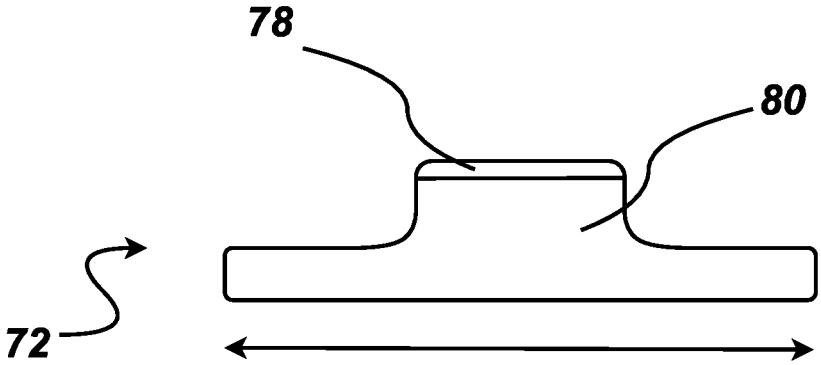
FIG. 9 is an isometric bow elevational view of a second seat configured to be received in the insert of FIG. 1.

As shown in FIGS. 5 and 7, a gutter 46 in the insert 2 extends along at least the central region 40 of the floor 8 and, in some embodiments, extends around the entire perimeter of the floor 8, including the central region 40, the bow region 42, and the stern region 44. As shown in FIGS. 5 and 7, the floor 8 has a slight crown or camber, at least in the central region 40, that extends from the port portion to the starboard portion and that peaks along the longitudinal axis of the insert 2 to promote water running off the floor 8 toward the peripheral gutter 46 and to increase the structural integrity and rigidity. In some embodiments, the gutter 46 is solid, making the insert 2 water-tight and thus buoyant. Accordingly, if the inflatable boat 4 loses buoyancy, the insert 2 facilitates continued flotation for the passengers, especially after unnecessary gear (for example, coolers, food, beverages, or others) is offloaded to decrease weight, thereby improving safety for the passengers.

As shown in FIG. 3, the sidewall 10 defines multiple boat couplers, such as the boat couplers 47-56, that are configured to secure the insert 2 to the boat 4. In some embodiments, anchoring features are disposed along the top of the peripheral tube 6 (for example, D-ring patches, such as polyvinyl chloride patches having D-rings secured thereto, with such patches being adhered to the boat 4), and the boat couplers 47-56 are disposed in the sidewall 10 at positions that substantially align with such features to facilitate running straps from or through such features to or through the boat couplers 47-56 (for example, woven nylon straps, such as those available under the mark CORDURA) to secure the insert 2 in the boat 4. If the boat 4 begins to lose or loses buoyancy (for example, two or more of the chambers are punctured), the straps may be decoupled (for example, untied or cut) from the boat couplers 47-56 or the anchoring features to enable separating the insert 2 from the boat 4, the boat 4 may be rolled up and either left on shore or brought into the insert 2, and the insert 2 may be used as a boat to proceed to safety.

In some embodiments, the boat couplers 47-56 include slots defined in the upper portions of the sidewall 10, such as slots having a major dimension of approximately 1.25-1.5 inches and a minor dimension of approximately 0.25 inches and spaced approximately 0.75 inches from the peripheral edge of the insert 2. Ten boat couplers 47-56 are shown, but this number and the spacing of such couplers varies based on the model or size of the inflatable boat for which the insert is intended. When the insert 2 is disposed in the boat 4 without securing the insert 2 to the boat 4 (other than under the force of gravity), the insert 2 may automatically separate from the boat 4 when the boat loses buoyancy as the boat 4 begins to sink and is pulled away from the insert 2.

In some embodiments, the insert 2 defines a solid gutter 46 disposed between the floor 8 and the sidewall 10. The floor 8 defines at least one drain, and the insert 2 has a water-tight cap for each drain, such as the caps 62, 64 shown in FIG. 3, to facilitate draining water from the insert 2 into the space between the floor 8 of the insert 2 and the floor 12 of the inflatable boat 4. The caps are threadably coupled to such drains, and the drains are disposed above or near the inflation or deflation valves (not shown) for the floor chamber of the boat 4 to facilitate inflating and deflating the boat 4 while the insert 2 is disposed in the boat. In some embodiments intended for use on urban rivers near a telephone or car, the gutter 46 includes perforations (not shown) to promote passage of water collected in the gutter 46 to space between the floor 8 of the insert 2 and the floor 12 of the inflatable boat 4 (see FIGS. 6 and 7), thereby promoting maintenance of a dry surface for passengers to stand on and thus increasing safety of the passengers (i.e., the insert 2 may be self-bailing).

The insert 2 is symmetric about its longitudinal axis (the major horizontal axis of the insert 2). In embodiments for boats such as the boat 4 that have a tube 6 extending about the entire circumference of the boat 4, the insert 2 is symmetric about its lateral axis (the minor horizontal axis of the insert 2). The boat 4 is 14 feet long. For larger boats, the insert 2 may not be symmetric front to back to facilitate different seating arrangements to move the captain away from the center of the boat, such as having ⅔ of the boat in front of the oarsman as dictated by the positions of the oar-lock platforms and the seat receptacles being shifted toward the stern or bow of the boat. The seat receptacles positioned for the person rowing are spaced aft of the oar-lock platforms by approximately the same amount, regardless of the position of such oar-lock platforms to facilitate the oarsman sitting on a bench disposed in such receptacles and using oars extending through oar locks mounted on such oar-lock platforms.

The insert 2 is configured to be nestingly received by another of such inserts and is configured to nestingly receive another of such inserts (without modification to the insert from storage and use in the boat 4) to facilitate compact storage of numerous such inserts. In some embodiments, the insert 2 is seamless to increase structural integrity and reduce snaggable features. The insert 2, including the floor 8 and peripheral sidewall 10, are preferably integral to each other to further reduce snaggable features. Accordingly, the insert 2 is configured to provide a rigid floor, even when installed in white-water rafting boats that have inflatable hulls.

In some embodiments, the insert is manufactured with composite infusion, such as carbon fiber open molding or infusion, fiberglass open molding or infusion, or others, by laying up dry composite layers in an open mold that defines an inverted shape of the insert, applying a vacuum surface such as a bag to an opposite side of the layers after laying them up, pulling a vacuum in the space defined by the surface and the open mold (with the layers in such space), and injecting resin into such space. Accordingly, the manufacturing process facilitates a unitary body for the insert that provides improved structural integrity over multiple hand-laid composite components that are subsequently joined to form the body.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular. The term "one or more" discloses no more than a single one or more than one, up to and including all.

The terms "bow," "forward," "stern," and "aft" are defined relative to the longitudinal axis of the insert 2 to orient the reader and do not limit the orientation of any described component in a given application. The terms "inner", "inward", "outer", and "outward" are defined relative to the passenger area of the insert 2 or boat 4, with the terms "inner" and "inward" referencing a direction generally extending toward the intersection of the longitudinal and lateral axes of the insert 2 or boat 4 and with the terms "outer" and "outward" referencing a direction generally extending away from such intersection. The term "transverse" refers to a non-parallel orientation and includes but is not limited to a perpendicular orientation.

The term "rigid" refers to elements with a modulus of rigidity that is at least 0.05, 0.1, or 0.15 Gpa.

The terms "thwart", "yoke", and "crossbeam" refer to components that are fixed or fastened to the boat or insert. Accordingly, the seats 70, 72 are not thwarts, yokes, or crossbeams.

The term "snag-free" refers to elements lacking projections such as thwarts, yokes, crossbeams, tubes, or fasteners and lacking non-radiused corners. The term "snaggable" refers to features that are omitted from a snag-free element, including projections such as thwarts, yokes, crossbeams, tubes, or fasteners and including non-radiused corners.

The term "most" refers to a majority, inclusive of an entirety.

The term "removably" refers to an element being configured to perform the described action of the verb modified by the term "removably" with the ability to remove the acted upon element from the described object of the phrase without the use of tools beyond human hands and without damaging either of the elements.

The term "configured" refers to an element being one or more of sized, dimensioned, positioned, or oriented to achieve or provide the recited function or result. The term "directly coupled" refers to a component that contacts (for example, when bolted), is integral with, or is welded to another component. The term "indirectly coupled" refers to a component that is coupled to one or more other components that are coupled to a second component or one or more further components that are coupled to the second component. The term "coupled" should be understood to disclose both direct and indirect coupling of components or elements that are described as being coupled to each other, and different embodiments may be directly coupled or indirectly coupled.

While the preferred embodiment of the invention has been illustrated and described, as noted above, many changes can be made without departing from the spirit and scope of the invention. For example, each disclosure of an element or component preferably having a feature or characteristic is intended to also disclose the element or component as being devoid of that feature or characteristic, unless the principles of the invention clearly dictate otherwise. Accordingly, the scope of the invention is not limited by the disclosure of the preferred embodiments. Moreover, each feature, characteristic, element, or component described herein may be implemented in combination with one or more other features, characteristics, elements, or components described herein.

The invention claimed is:

1. An insert for an inflatable boat having a hull and an inflatable peripheral tube, an upper surface of the hull and an inner surface of the peripheral tube defining a boat cockpit, the insert comprising:

a rigid floor that has a floor periphery; and a rigid peripheral sidewall that extends upward from the floor periphery and that is coupled to the floor, wherein the floor and the peripheral sidewall define an insert cockpit, wherein the insert is configured to removably register with the boat cockpit while the floor of the insert covers most of the upper surface of the hull and while the peripheral sidewall of the insert covers most of the inner surface of the peripheral tube, whereby the insert facilitates increasing rigidity of the inflatable boat while reducing snaggable features in the inflatable boat, wherein the peripheral sidewall is configured to extend over an upper surface of the peripheral tube when the insert is in registration with the boat cockpit, the peripheral sidewall defining oar-lock platforms that are configured to retain oar locks.

2. The insert of claim 1, wherein the insert is devoid of crossbeams and thwarts.

3. The insert of claim 1, wherein the insert is devoid of non-radiused corners.

4. The insert of claim 1, wherein the peripheral sidewall is configured to extend along a port portion of the peripheral tube and along a starboard portion of the peripheral tube when the insert is in registration with the boat cockpit, the peripheral sidewall defining a port recess and a starboard recess that is opposite the floor from the port recess, the port recess and the starboard recess being configured to registrably receive a seat.

5. The insert of claim 1, wherein the floor defines a central region, a bow region, and a stern region, the bow region being disposed forward of the central region and defining a forward incline that extends upward from the central region, the stern region being disposed aft of the central region and defining a rearward incline that extends upward from the central region.

6. An insert for an inflatable boat having a hull and an inflatable peripheral tube, an upper surface of the hull and an inner surface of the peripheral tube defining a boat cockpit, the insert comprising:

a rigid floor that has a floor periphery; and a rigid peripheral sidewall that extends upward from the floor periphery and that is coupled to the floor, wherein the floor and the peripheral sidewall define an insert cockpit, wherein the insert is configured to removably register with the boat cockpit while the floor of the insert covers most of the upper surface of the hull and while the peripheral sidewall of the insert covers most of the inner surface of the peripheral tube, whereby the insert facilitates increasing rigidity of the inflatable boat while reducing snaggable features in the inflatable boat, wherein the floor defines a drain hole in a bow region of the insert cockpit or in a stern region of the cockpit, the drain hole being disposed at a position in the floor that is configured to horizontally align with a valve in a floor chamber of the hull when the insert is in registration with the boat cockpit.

7. The insert of claim 6, wherein the floor defines a crown that peaks along a central axis of the floor.

8. The insert of claim 6, wherein the insert includes a cap that is configured to plug the drain hole.

9. The insert of claim 8, wherein the cap is configured to plug the drain hole in a water-tight manner.

10. An insert for an inflatable boat having a hull and an inflatable peripheral tube, an upper surface of the hull and an inner surface of the peripheral tube defining a boat cockpit, the insert comprising:

a rigid floor that has a floor periphery; and a rigid peripheral sidewall that extends upward from the floor periphery and that is coupled to the floor, wherein the floor and the peripheral sidewall define an insert cockpit, wherein the insert is configured to removably register with the boat cockpit while the floor of the insert covers most of the upper surface of the hull and while the peripheral sidewall of the insert covers most of the inner surface of the peripheral tube, whereby the insert facilitates increasing rigidity of the inflatable boat while reducing snaggable features in the inflatable boat, wherein the insert defines a gutter that extends at least partially around the floor, an upper surface of the gutter being disposed below an upper surface of the floor, wherein the gutter defines perforations.

11. The insert of claim 1, wherein an upper third of the peripheral sidewall defines boat couplers that facilitate removably securing the insert in the boat cockpit.

12. The insert of claim 1, wherein the oar-lock platforms are configured to directly retain oar locks.

13. The insert of claim 1, wherein the oar-lock platforms are configured to indirectly retain oar locks.

14. The insert of claim 10, wherein the insert is devoid of crossbeams and thwarts.

15. The insert of claim 10, wherein the insert is devoid of non-radiused corners.

16. An insert for an inflatable boat having a hull and an inflatable peripheral tube, an upper surface of the hull and an inner surface of the peripheral tube defining a boat cockpit, the insert comprising:

a rigid floor that has a floor periphery; and a rigid peripheral sidewall that extends upward from the floor periphery and that is coupled to the floor, wherein the floor and the peripheral sidewall define an insert cockpit, wherein the insert is configured to removably register with the boat cockpit while the floor of the insert covers most of the upper surface of the hull and while the peripheral sidewall of the insert covers most of the inner surface of the peripheral tube, whereby the insert facilitates increasing rigidity of the inflatable boat while reducing snaggable features in the inflatable boat, wherein a portion of the peripheral sidewall is configured to extend over an upper surface of the peripheral tube when the insert is in registration with the boat cockpit, the portion of the peripheral sidewall provides support for an oar lock.

17. The insert of claim 16, wherein the portion of the peripheral sidewall is configured to directly support oar locks.

18. The insert of claim 16, wherein the portion of the peripheral sidewall is configured to indirectly support oar locks.

19. The insert of claim 16, wherein the insert is devoid of crossbeams and thwarts.

20. The insert of claim 16, wherein the insert is devoid of non-radiused corners.

* * * * *